US006397600B1

(12) United States Patent
Romanelli

(10) Patent No.: US 6,397,600 B1
(45) Date of Patent: Jun. 4, 2002

(54) CLOSED LOOP FLUOROCARBON CIRCUIT FOR EFFICIENT POWER GENERATION

(76) Inventor: Pat Romanelli, 224 Brook St., Harrington Park, NJ (US) 07640

( * ) Notice: Subject to any disclaimer, the term of this patent is extended or adjusted under 35 U.S.C. 154(b) by 0 days.

(21) Appl. No.: 09/974,543

(22) Filed: Oct. 9, 2001

(51) Int. Cl.[7] ..... F01K 25/00
(52) U.S. Cl. ..... 60/671; 60/651
(58) Field of Search ..... 60/651, 670, 671

(56) References Cited

U.S. PATENT DOCUMENTS

| | | | | | |
|---|---|---|---|---|---|
| 3,938,334 | A | | 2/1976 | Matthews | 60/641 |
| 4,009,082 | A | | 2/1977 | Smith, Jr. | 203/11 |
| 4,080,791 | A | * | 3/1978 | Nadler et al. | 60/670 |
| 4,086,772 | A | | 5/1978 | Williams | 60/651 |
| 4,170,116 | A | | 10/1979 | Williams | 62/116 |
| 4,270,350 | A | | 6/1981 | Chevalier | 60/516 |
| 4,276,748 | A | | 7/1981 | Wahl, III et al. | 60/641 |
| 4,283,211 | A | * | 8/1981 | Ehrlich et al. | 62/4 |
| 4,321,799 | A | | 3/1982 | Pierotti et al. | 62/112 |
| 4,357,212 | A | | 11/1982 | Osterman et al. | 202/170 |
| 4,372,126 | A | | 2/1983 | Sebald | 60/669 |
| 4,481,775 | A | | 11/1984 | Beveridge | 60/649 |
| 4,698,973 | A | | 10/1987 | Johnston | 60/670 |
| 4,805,410 | A | | 2/1989 | Johnston | 60/671 |
| 4,920,750 | A | | 5/1990 | Iishiki et al. | 60/671 |
| 4,978,467 | A | | 12/1990 | Shankland et al. | 252/69 |
| 5,400,615 | A | | 3/1995 | Pearson | 62/277 |
| 5,403,504 | A | | 4/1995 | Bivens et al. | 252/67 |
| 5,775,107 | A | | 7/1998 | Sparkman | 60/641.8 |
| 5,867,978 | A | * | 2/1999 | Klanchar et al. | 60/39.182 |
| 5,910,100 | A | * | 6/1999 | Hooper | 60/651 |
| 6,176,102 | B1 | | 1/2001 | Novak | 62/612 |

OTHER PUBLICATIONS

Allied Signal Chemicals, Genetron AZ–20 (R–410A) Product Brochure on Fluorocarbons pp. 1–12 (1995).

Allied Signal Chemicals, Genetron Product Brochure on Fluorocarbons, pp. 1–12 (1995).

* cited by examiner

*Primary Examiner*—Hoang Nguyen
(74) *Attorney, Agent, or Firm*—Winston & Strawn

(57) ABSTRACT

A method and apparatus for efficiently generating mechanical energy. The method includes the steps of heating a vaporizable, first liquid heat transfer medium to generate a high pressure vapor; utilizing the high pressure vapor to provide mechanical energy and thereafter condensing the vapor to a liquid; and recycling the condensed liquid to the heating step for re-use as the first liquid heat transfer medium. The apparatus includes a closed loop heat transfer medium system having a first heat exchanger for heating a vaporizable, first liquid heat transfer medium to generate a high pressure vapor; a mechanical device which utilizes the high pressure vapor to provide mechanical energy; a condenser for condensing the vapor to a liquid; and piping for fluidly connecting the first heat exchanger, mechanical device and condenser, and for recycling the condensed liquid to the first heat exchanger for re-use. The first heat transfer medium is preferably maintained in a hermetically sealed circuit so that essentially no loss of heat transfer medium occurs during the heating and condensing steps, and is a fluorocarbon or fluorocarbon mixture that (a) generates a high pressure of at least 400 psi at a pressure generation temperature that is below the boiling point of water, (b) has a boiling point which is below the freezing point of water, and (c) has a critical temperature which is above that of the pressure generation temperature.

32 Claims, 1 Drawing Sheet

CLOSED LOOP FLUOROCARBON CIRCUIT FOR EFFICIENT POWER GENERATION

TECHNICAL FIELD

The invention relates to the development of energy for the purpose of creating power that can be used in a variety of applications, including the generation of electric power or motive power for land, marine or air transportation.

BACKGROUND

The present day forms of creating power are generally dependent upon the burning of fossil fuels to generate electric power. In doing so, a serious environmental problem is created in the form of air, water and land pollution. Also, in burning such fuels to create kinetic energy, thermal efficiencies are relatively inefficient due to the formation of incomplete combustion products. This results in exhaust pollution of these products, such as carbon monoxide, carbon dioxide, nitrous oxides and particulates.

Certain attempts have been made to create power without generating such pollutants. Williams U.S. Pat. Nos. 4,086,772 and 4,170,116 disclose a continuous method and closed cycle system for converting thermal energy into mechanical energy. This system comprises vaporizing means, including an energy conversion tube having a special nozzle section, for converting a liquid working fluid stream to a vapor stream. This vapor stream operates a turbine means wherein a portion of the energy of the vapor stream is converted to mechanical shaft work. This system also includes means for increasing the thermal and static energy content of the fluid stream, this means typically being pump means. The vapor fraction of that exits the turbine means passes through condensing means, such as a diffuser, to regenerate the working liquid stream. Finally, means are provided for recycling the condensed liquid stream back to the vaporizing means. The working fluid may be carbon dioxide, liquid nitrogen, or a fluorocarbon. Preferred fluorocarbons are difluoromonochloromethane, pentafluoromonochloroethane, difluorodichloromethane and mixtures and azeotropes thereof.

Johnston U.S. Pat. Nos. 4,805,410 and 4,698,973 disclose closed loop systems that recirculate a vaporizable working fluid between its liquid and vapor states in a thermodynamic working cycle. In this cycle, energy received from an external energy source is utilized to vaporize the fluid to a high pressure in a boiler unit. The resulting vapor is utilized in an energy utilizing device, such as a slidable piston which causes rotation of a crank shaft coupled to a flywheel to deliver mechanical output at a rotating shaft connected thereto. Thereafter, the vapor is condensed into a condensate at a relatively lower pressure in a condensing unit and then is returned to the boiler unit for repeating of the thermodynamic cycle. Also, the condensate flow between the condensing unit and boiler unit is collected in one of two holding tanks in selective pressure communication with the boiler unit. Preferred working fluids include water, Freon or ammonia. Also, thermal regeneration means may be included for providing regenerative heating of the working fluid.

While these prior art systems are somewhat suitable for their intended purpose, there remains a need for improvements in power generation, in particular for small, more efficient systems for generating torque and power. This is now provided by the embodiments of the present invention disclosed herein.

SUMMARY OF THE INVENTION

The present invention relates to a method for efficiently generating mechanical energy which comprises heating a vaporizable, first liquid heat transfer medium to generate a high pressure vapor; utilizing the high pressure vapor to provide mechanical energy and thereafter condensing the vapor to a liquid; and recycling the condensed liquid to the heating step for re-use as the first liquid heat transfer medium. The first heat transfer medium is maintained in a hermetically sealed circuit so that essentially no loss of the heat transfer medium occurs during the heating and condensing steps.

Advantageously, the first liquid heat transfer medium comprises a fluorocarbon or fluorocarbon mixture that (a) generates a high pressure of at least 400 psi at a pressure generation temperature that is below the boiling point of water, (b) has a boiling point which is below the freezing point of water, and (c) has a critical temperature which is above that of the pressure generation temperature. Preferably, the first liquid heat transfer medium comprises a fluorocarbon mixture that (a) generates a high pressure of at least 500 psi at a pressure generation temperature that is below 190° F., (b) has a boiling point which is at least 10 degrees F below the freezing point of water, and (c) has a critical temperature which is above 150° F.

The heating step advantageously comprises heating a second liquid heat transfer medium which is different from the first heat transfer medium and utilizing the heated second heat transfer medium to heat and vaporize the first heat transfer medium. The second heat transfer medium is preferably heated to a temperature of less than 200° F. by nuclear energy, solar energy, electric energy, or combustion of fossil fuels, natural or synthetic gases, alcohol, or vegetable or plant material. The heated second medium is passed through heat exchanger tubes which are in contact with and heat the first medium.

The vapor utilizing step comprises passing the vapor through a turbine to rotate a shaft for generation of power or torque. The rotating shaft may be operatively associated with vehicle wheels to provide motion to the vehicle. When arranged in this manner, the vapor pressure passing through the turbine can be reversed to provide braking to the wheels and vehicle.

Alternatively, the vapor utilizing step may include utilizing the pressure of the vapor to operate one or a plurality of pistons in an engine to generate horsepower. The engine may be located on a boat or ship and is operatively associated with a propeller or blade to provide marine propulsion. Also, the vapor utilizing step may comprise passing the vapor through a turbine of an aircraft engine to provide flight propulsion.

The vapor may be condensed in an air cooled condenser, or in a heat exchanger where heat is recovered from the vapor and utilized elsewhere. If desired, the movement of the first heat transfer medium in the circuit can be assisted by pumping it from the vapor utilizing step to the condensing step. In addition, valving can be included to assist in movement of the medium.

The invention also relates to an apparatus for efficiently generating power or torque which comprises a closed loop heat transfer medium system comprising a first heat exchanger for heating a vaporizable, first liquid heat transfer medium to generate a high pressure vapor; a mechanical device which utilizes the high pressure vapor to provide mechanical energy; a condenser for condensing the vapor to a liquid; and piping for fluidly connecting the first heat exchanger, mechanical device and condenser, as well as for recycling the condensed liquid to the first heat exchanger for re-use.

The first heat exchanger has exchanger tubes that include therein a second liquid heat transfer medium which is different from the first heat transfer medium, and the apparatus further comprises a second heat exchanger for heating second heat transfer medium, wherein the heated second heat transfer medium is passed through the exchanger tubes of the first heat exchanger to heat and vaporize the first heat transfer medium. The second heat transfer medium is heated to a temperature of less than 200° F. by a heating device that is powered by nuclear energy, solar energy, electric energy, or combustion of fossil fuels, alcohol, or vegetable or plant material.

The first heat transfer medium is generally maintained in a hermetically sealed circuit so that essentially no loss of heat transfer medium occurs during the heating and condensing steps. Also, the mechanical device may be a turbine that rotates a shaft for generation of power or torque, or an engine that includes one or more pistons with the pressure of the vapor utilized to operate one or more of the pistons in the engine to generate horsepower. The engine may be located on a boat or ship and be operatively associated with a propeller or blade to provide marine propulsion. Alternatively, the mechanical device may be a turbine of an aircraft engine with the pressure of the vapor utilized to operate the turbine to provide flight propulsion.

The apparatus may further comprise a pump for directing the first heat transfer medium from the vapor utilizing to the condensing steps. Also, valving may be provided for assisting in directing movement of the first heat transfer medium. Preferably, the valving is electronically controlled and a programmable controller is utilized for electronically controlling the valving to assist in directing the movement of the first heat transfer medium. As the first heat transfer medium is preferably maintained in the system at a temperature of below 190° F, the piping and equipment that handles that medium can be made of plastic materials of construction.

BRIEF DESCRIPTION OF THE DRAWINGS

The sole drawing FIGURE is a schematic that illustrates the novel closed loop heat transfer circuit of the invention.

DETAILED DESCRIPTION OF THE PREFERRED EMBODIMENTS

Figure 1:
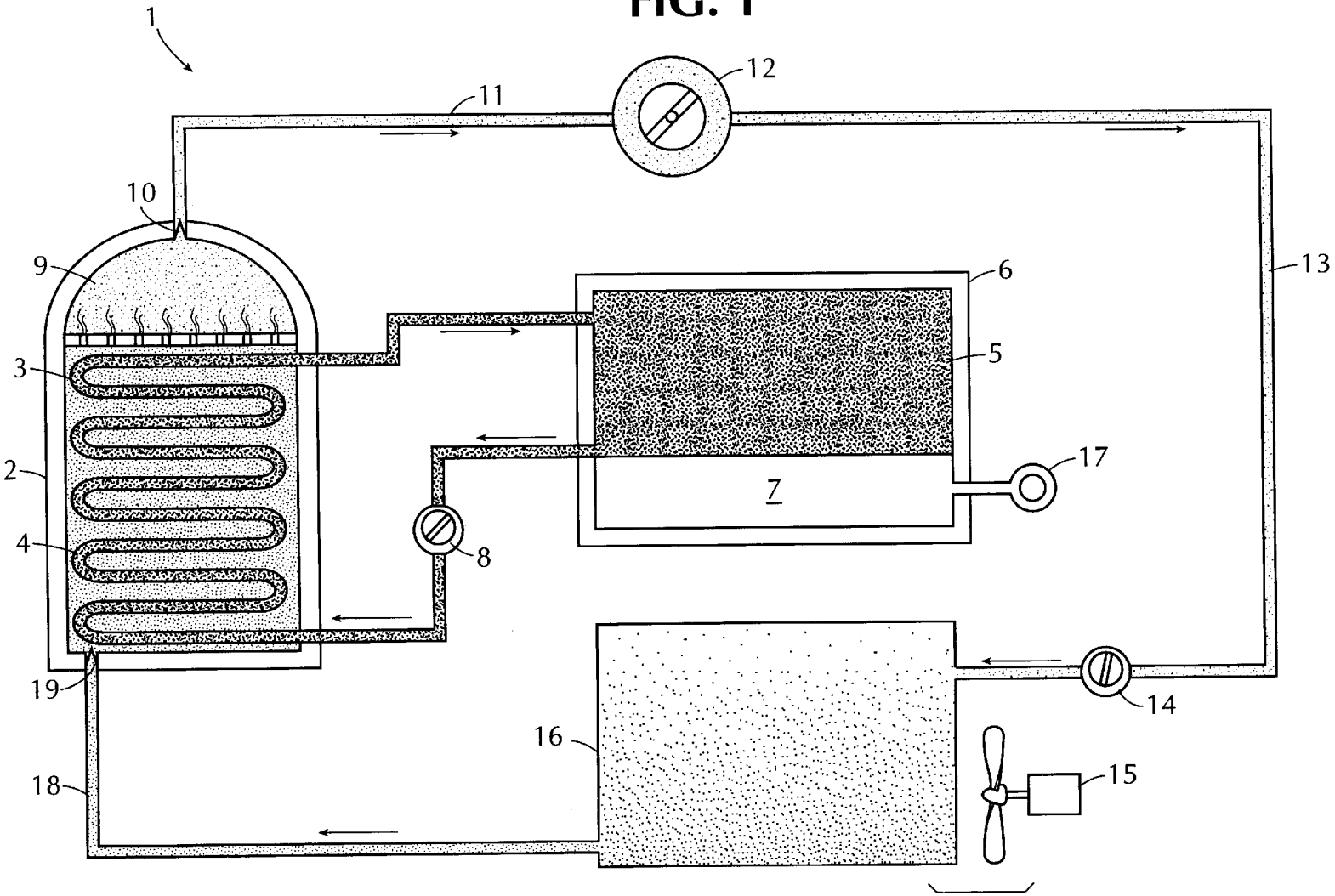

The present invention deviates from the known art by utilizing low temperatures and low boiling point heat transfer mediums in a hermetically sealed system to provide novel power sources. The invention operates at temperatures below 200° F and preferably at a maximum temperature of about 150° F. to avoid combustion of the medium, and to eliminate or significantly reduce the discharge of any gaseous or particulate pollutants. The low temperature also enables low cost, lightweight materials to be used for the equipment that handles the medium, thus enabling light weight engines or other mechanical force generating devices to be made and used.

Any one of a wide variety of heat transfer mediums can be utilized in this invention. Advantageously, these mediums generate relatively high pressures at temperatures that are well below the boiling point of water, and generally below 190° F. for the specific mediums disclosed herein. These mediums also have boiling temperatures that are significantly below the freezing point of water. Pressures of at least about 400 to as high as about 500 to 700 psi can be provided at a temperature in the range of about 120 to 180° F., with the most preferred mediums having pressure generating temperatures of between about 140 and 160° F. These high pressures are advantageous for efficiently operating turbines or related equipment for generating power or torque.

The most advantageous mediums are fluorocarbons, and while a single fluorocarbon may be used alone, it is preferred to instead use various mixtures and most preferably to utilize azeotropic mixtures. Suitable fluorocarbons for use as mediums include difluoropentafluoroethane, trifluoromethane, pentafluoroethane, tetrafluoroethane, and trifluoroethane. Certain mixtures may contain small amounts of other gases such as hydrocarbons or halogenated hydrocarbons provided that the overall properties of the mixture meet the above-stated property requirements.

The most preferred fluorocarbons and fluorocarbon mixtures include HFC-125, Blends 404A, 407C, and HP-80, Azeotrope 502, and Azeotropic mixtures AZ-20 and AZ-50, all of which are available from Allied Signal Chemicals, Morristown, N.J. AZ-20 is disclosed in US Pat. No. 4,978,467, while AZ-50 is disclosed in U.S. Pat. No. 5,211,867. Other useful fluorocarbon mixtures are disclosed in U.S. Pat. No. 5,403,504. Each of these three patents is expressly incorporated herein by reference to the extent needed to understand these compounds.

The following table illustrates the critical temperature and pressure generation at various temperatures for the most preferred heat transfer mediums.

| material | pressure (psi) at temperature | | | |
|---|---|---|---|---|
| (critical temp.) | 120° F. | 130° F. | 140° F. | 150° F. |
| AZ-20 (163° F.) | 417.7 | 475.6 | 538.9 | 608.1 |
| HP-80 (168.3° F.) | 335.6 | 331.5 | 431.5 | 485.8 |
| 125 (151° F.) | 345.3 | 393.1 | 445.4 | 502.4 |
| AZ-50(160° F.) | 321.9 | 367.8 | 418.7 | 475.3 |
| 404A (162.3° F.) | 309.8 | 353.1 | 400.4 | 452.0 |
| 502 (180° F.) | 282.7 | 320.6 | 362.6 | 408.4 |
| 407C (189.1° F.) | 266.7 | 307.7 | 353.3 | 403.1 |

The most preferred heat transfer medium is known as AZ-20. This medium is an azeotropic fluorocarbon mixture having a boiling point of −62.9° F. This material generates a pressure of over 600 psi when heated to a temperature of 150° F. This heating step requires extremely low energy levels to reach this temperature and maintain it, thus allowing high pressures to be attained with modest heating requirements.

All of the preferred mediums have boiling points which are at least about 14 and generally at least about 20 degrees F below the freezing point of water. Also, the critical temperatures for these mediums are between 150 and 190° F., and generally around 160 to 170° F. These properties guarantee low temperature operation for generation of operational pressures.

As the amount of energy required to warm the medium to its operating pressure is modest, all that is required is a relatively small heating unit for this purpose. Such a unit can operate on any one of a wide variety of energy sources, including nuclear, electric, solar, natural or hydrocarbon gases, or alternative fossil fuels such as alcohol, vegetable oils or other replenishable materials. The heating unit can directly or indirectly heat the medium. For example, a second heat transfer fluid can be heated by the heating unit, and the heated second medium can be used to heat the first heat transfer medium.

One of ordinary skill in the art will readily recognize that electric power for public and industrial use can be generated from the present system by simply applying heat from various available sources. These sources include thermowells and springs, or even sunlight, supplemented where necessary by sources such as natural or other hydrocarbon gas, other fossil fuels or any of the sources described above, to obtain the relatively low temperature for heating the medium. This in turn reduces the size of power plants to a sufficiently small and compact arrangement so that they can be utilized locally in a town, a building or even in a person's home.

The hermetic sealing of the system avoids the generation of environmental pollutants, cooling systems are not required and the system can be operated at extremely low noise levels. When used, nuclear power plants for heating the medium can be sized at a fraction of their current size due to the low operating temperatures needed for the present system. Also, any waste heat that is generated can be collected and diverted to the source for heating the medium.

Referring to FIG. 1, there is illustrated a vapor engine 1 according to the invention. A vessel 2 contains a liquid heat transfer medium, 3, preferably AZ-20 as noted above, which medium is capable of generating a high pressure when heated to a vapor. For this reason, vessel 2 is provided with a heat exchanger 4. The heat exchanger contains ethylene glycol 5 and is connected to a vessel 6 that contains a supply of that medium. The vessel 6 is heated by a boiler heat exchanger 7 or other suitable heating means to a temperature of about 155° F. As the critical temperature of AZ-20 is 163° F., the operation temperature is maintained below 160° F. The boiler 7 can be heated by any one 17 of a number of sources, including nuclear, combustion of fossil fuel, natural gas or alcohol, electric, solar, or combinations thereof. Pump 8 circulates glycol 5 between the heat exchanger 4 and the supply vessel 6.

Heat from glycol 5 in heat exchanger 4 causes the AZ-20 to vaporize and generate a high pressure vapor 9 in the upper part of vessel 2. Check valve 10 assures proper flow of the high pressure vapor 9 through piping 11 and to turbine 12 or other power producing device. If desired, electricity can be generated or the turbine can be operatively associated with wheels or other motion generating devices to product torque or other forces to drive the device. Thereafter, vapor 9 continues through piping 13, urged by pump 14, to condenser 16, where fan 15 cools the gas and returns it to a liquid. This liquid passes through piping 18, and through check valve 19 into vessel 1 for re-use.

As noted above, the invention has utility for automotive and marine transportation, and due to the low temperatures of operation, the materials of construction for the equipment can be engineering thermoplastics such as nylon, polycarbonate, moldite, thermosetting plastics or composites and the like. Also, lightweight metals such as aluminum, titanium or magnesium can be used. This significantly reduces the complexity and weight of the engine that contains the system of the invention. This also simplifies servicing of the engine, with long life and reliable operation being provided. As there is no internal combustion, there is no exhaust and no air pollution generated.

Furthermore, no transmission is needed as the output can be used to directly drive the wheels. The engine has torque and horsepower of larger internal combustion engines due to the relatively high applied pressure of the vapor for the full stroke of the piston. The moving parts of the engine would be permanently lubricated so that no further maintenance is required. Also, no radiator or water system is required.

Electronically controlled valving facilitates operation of the system, and the heat transfer mediums are non-flammable, so that there is no concern of an engine fire. The return line for the condensed first liquid heat transfer medium can be used for this purpose, as this assists in warming the liquid and generating the vapor. When this system is used as the engine of a vehicle, the relatively cold return line can also be used to cool air for providing air conditioning to the vehicle occupants. The cooling of all electronic devices in the system increases the reliability and life of the components. A master control unit is the heart of the control system and is programmed to perform all functions.

The system is not affected by atmospheric conditions, i.e., barometric pressure, humidity or temperature. The reliability of all components is assured by the hermetics of the system. The complete isolation of the system from atmospheric exposure contributes to the long operational life of the system.

An important feature of this system is the elimination of all internal fuel components, such as injectors, fuel pumps, catalytic converters, fuel rails, and sensors which are costly, troublesome and hazardous but are necessary to the operation of an internal combustion engine.

The vapor engine of the present invention is similar in operation to the steam engine of the early 1900s. Nothing matches the tremendous power and flexibility of those engines, and the present vapor engine can approximate the features of a steam engine. It can rotate in either direction or instantly stop to act as a brake. This eliminates transmissions of the Stanley Steamers of the 1900s, resulting in less expensive drive lines for all means of transportation, farm and construction equipment. Power for external use is transmitted via a motor shaft through a housing which is sealed by modern technology high pressure seals such as those used in automotive air conditioners.

As a practical working example, an aircraft engine that incorporates a propulsion system that is energized by a small safe and dependable nuclear power plant can provide an immensely increased payload and range to the aircraft due to the substantial reduction of aviation fuel that would be otherwise conventionally required. Nuclear fuel pellets of a size of a few millimeters diameter and length are more than sufficient to generate the heat needed to vaporize the heat transfer medium that is used in the present system.

The invention also has utility in military applications. Due to the quiet operation, non-exhaust and high power output of the invention, it can be used in tanks, aircraft, ground support vehicles and marine transport vehicles.

EXAMPLE

The following is provided as a comparison of power between an internal combustion engine and a vapor engine according to the invention.

A cylinder with a 4" bore and a 3" stroke has 37.7 cubic inches. The compression ratio is 8.54:1. A combustion force of 5000 pounds translates into 625 pound feet of instantaneous torque.

The same cylinder of the vapor engine of the invention, disregarding the compression ratio with 4241.16 pounds of pressure $(0.7854\times3\times3)=7.0686\times600$ pounds=4241.16), gives 530.145 pound feet of continuous torque for the full stroke of the crank. This can be compared to the internal combustion engine where force is gradually depleted as combustion ceases. The internal combustion engine then has to proceed through a four cycle process to repeat the power cycle.

The vapor engine of the present invention is double acting in that it develops power with each and every stroke of the piston. This results in a smaller engine with more power and smoother operation. As the intake and exhaust systems are not exposed to the atmosphere, and the system operates at a relatively low temperature of 150° F., the transfer medium can be heated to create the vapor pressure using any one of a variety of non-polluting sources. The AZ-20 medium can be recycled and re-used many times over, resulting is low operation costs and maintenance. The engine can be configured as a piston engine of any reasonable number of cylinders depending upon desired horsepower, or as a turbine or vane type motor. The system can also be used to activate mechanisms requiring high pressure and low temperatures.

Having described the invention in detail herein and with reference to the referred embodiments thereof, it will be apparent that various modifications and variations are possible without departing from the true spirit and scope of the invention. For example, one of ordinary skill in the art can formulate various fluorocarbon heat transfer medium mixtures that will meet and even exceed the operational criteria set forth herein. Thus, it is specifically intended that all such modifications and variations be covered by appended claims.

What is claimed is:

1. A method for efficiently generating mechanical energy which comprises:

heating a vaporizable, first liquid heat transfer medium to generate a high pressure vapor;

utilizing the high pressure vapor to provide mechanical energy and thereafter condensing the vapor to a liquid; and recycling the condensed liquid to the heating step for re-use as the first liquid heat transfer medium;

wherein the first liquid heat transfer medium comprises a fluorocarbon or fluorocarbon mixture that (a) generates a high pressure of at least 400 psi at a pressure generation temperature that is below the boiling point of water, (b) has a boiling point which is below the freezing point of water, and (c) has a critical temperature which is above that of the pressure generation temperature.

2. The method of claim 1 wherein the first liquid heat transfer medium comprises a fluorocarbon mixture that (a) generates a high pressure of at least 500 psi at a pressure generation temperature that is below 190° F., (b) has a boiling point which is at least 10 degrees F below the freezing point of water, and (c) has a critical temperature which is above 160° F.

3. The method of claim 1 wherein the heating step comprises heating a second liquid heat transfer medium which is different from the first heat transfer medium and utilizing the heated second heat transfer medium to heat and vaporize the first heat transfer medium.

4. The method of claim 3 wherein the second heat transfer medium is heated to a temperature of less than 200° F. by nuclear energy, solar energy, electric energy, or combustion of a fossil fuel, a hydrocarbon gas, an alcohol, or a vegetable or plant material.

5. The method of claim 4 wherein the heated second heat transfer medium is passed through heat exchanger tubes which are in contact with the first heat transfer medium for heating of same.

6. The method of claim 1 wherein the first heat transfer medium is maintained in a hermetically sealed circuit so that essentially no loss of heat transfer medium occurs during the heating and condensing steps.

7. The method of claim 1 wherein the vapor utilizing step comprises passing the vapor through a turbine to rotate a shaft for generation of power or torque.

8. The method of claim 7 wherein the rotating shaft is operatively associated with vehicle wheels to provide motion to the vehicle.

9. The method of claim 8 wherein the passage of the vapor through the turbine is reversed to provide braking to the wheels and vehicle.

10. The method of claim 1 wherein the vapor utilizing step comprises utilizing the pressure of the vapor to operate one or a plurality of pistons in a engine to generate horsepower.

11. The method of claim 10 wherein the engine is located on a boat or ship and is operatively associated with a propeller or blade to provide marine propulsion.

12. The method of claim 1 wherein the vapor utilizing step comprises passing the vapor through a turbine of an aircraft engine to provide flight propulsion.

13. The method of claim 1 wherein the vapor is condensed in an air cooled condenser.

14. The method of claim 1 wherein the vapor is condensed in a heat exchanger where heat is recovered from the vapor and utilized elsewhere.

15. The method of claim 1 which further comprises pumping the first heat transfer medium from the vapor utilizing step to the condensing step.

16. An apparatus for efficiently generating power or torque which comprises:

a closed loop heat transfer medium system comprising a first heat exchanger for heating a vaporizable, first liquid heat transfer medium to generate a high pressure vapor;

a mechanical device which utilizes the high pressure vapor to provide mechanical energy;

a condenser for condensing the vapor to a liquid; and piping for fluidly connecting the first heat exchanger, mechanical device and condenser, and for recycling the condensed liquid to the first heat exchanger for re-use;

wherein the first liquid heat transfer medium comprises a fluorocarbon or fluorocarbon mixture that (a) generates a high pressure of at least 400 psi at a pressure generation temperature that is below the boiling point of water, (b) has a boiling point which is below the freezing point of water, and (c) has a critical temperature which is above that of the pressure generation temperature.

17. The apparatus of claim 16 wherein the first liquid heat transfer medium comprises a fluorocarbon mixture that (a) generates a high pressure of at least 500 psi at a pressure generation temperature that is below 190° F., (b) has a boiling point which is at least 20 degrees F below the freezing point of water, and (c) has a critical temperature which is above 160° F.

18. The apparatus of claim 16 wherein the first heat exchanger includes exchanger tubes that include therein a second liquid heat transfer medium which is different from the first heat transfer medium, and the apparatus further comprises a second heat exchanger for heating second heat transfer medium, wherein the heated second heat transfer medium is passed through the exchanger tubes of the first heat exchanger to heat and vaporize the first heat transfer medium.

19. The apparatus of claim 18 wherein the second heat transfer medium is heated to a temperature of less than 200° F. by a heating device that is powered by nuclear energy, solar energy, electric energy, or combustion of a fossil fuel, a hydrocarbon gas, an alcohol, or a vegetable or plant material.

20. The apparatus of claim 16 wherein the first heat transfer medium is maintained in a hermetically sealed circuit so that essentially no loss of heat transfer medium occurs during the heating and condensing steps.

21. The apparatus of claim 16 wherein the mechanical device is a turbine that rotates a shaft for generation of power or torque.

22. The apparatus of claim 21 wherein the rotating shaft is operatively associated with vehicle wheels to provide motion to the vehicle.

23. The apparatus of claim 22 which further comprises means for reversing the vapor pressure passing through the turbine to provide braking to the wheels and vehicle.

24. The apparatus of claim 16 wherein the mechanical device is an engine that includes one or more pistons and the pressure of the vapor is utilized to operate one or more of the pistons in the engine to generate horsepower.

25. The apparatus of claim 24 wherein the engine is located on a boat or ship and is operatively associated with a propeller or blade to provide marine propulsion.

26. The apparatus of claim 16 wherein the mechanical device is a turbine of an aircraft engine and the pressure of the vapor is utilized to operate the turbine to provide flight propulsion.

27. The apparatus of claim 16 wherein the condenser is an air cooled condenser.

28. The apparatus of claim 16 wherein the condenser is a heat exchanger where heat is recovered from the vapor and utilized elsewhere.

29. The apparatus of claim 16 which further comprises a pump for directing the first heat transfer medium from the vapor utilizing to the condensing steps.

30. The apparatus of claim 16 which further comprises valving for assisting in directing movement of the first heat transfer medium.

31. The apparatus of claim 30 wherein the valving is electronically controlled and a programmable controller or master control unit is utilized for electronically controlling the valving to assist in directing the movement of the first heat transfer medium.

32. The apparatus of claim 16 wherein the first heat transfer medium is maintained in the system at a temperature of below 190° F. so that piping and equipment that handles that medium can be made of plastic materials of construction.

* * * * *